US005860529A

United States Patent [19]

Smithson et al.

[11] Patent Number: 5,860,529

[45] Date of Patent: Jan. 19, 1999

[54] DISPENSERS FOR BAGS, AND BAGS FOR USE THEREWITH

[75] Inventors: Martin Dominic Smithson, Upton-upon-Severn; Robert Franklin, Aylesbury, both of United Kingdom

[73] Assignee: Cascade Dispensers Limited, United Kingdom

[21] Appl. No.: 784,359

[22] Filed: Jan. 17, 1997

[30] Foreign Application Priority Data

| | | | |
|---|---|---|---|
| Jan. 18, 1996 | [GB] | United Kingdom | 9601024 |
| Aug. 30, 1996 | [GB] | United Kingdom | 9618236 |

[51] Int. Cl.[6] ..... B65D 1/34

[52] U.S. Cl. ..... 206/554; 248/100

[58] Field of Search ..... 206/554; 248/99, 248/100, 101; 383/37

[56] References Cited

U.S. PATENT DOCUMENTS

| | | | |
|---|---|---|---|
| 2,925,175 | 2/1960 | Williamson et al. | 206/554 |
| 3,388,882 | 6/1968 | Burroughs et al. | 248/101 |
| 3,912,208 | 10/1975 | Grenetier | 248/99 |
| 4,280,811 | 7/1981 | Howe, Jr. | 206/554 |
| 4,493,419 | 1/1985 | Prader et al. | 206/554 |
| 4,805,969 | 2/1989 | Heacock | 206/554 |
| 5,421,803 | 6/1995 | Kemanjian . | |
| 5,465,845 | 11/1995 | Norby et al. | 206/554 |
| 5,469,970 | 11/1995 | Li . | |
| 5,524,762 | 6/1996 | Shafran et al. | 206/554 |
| 5,667,173 | 9/1997 | Wilfong, Jr. et al. | 248/100 |

FOREIGN PATENT DOCUMENTS

| | | | |
|---|---|---|---|
| 761553 A1 | 3/1997 | European Pat. Off. . | |
| 1539708 | 10/1968 | France | 206/554 |
| 2234734 | 2/1991 | United Kingdom . | |
| WO9308720 | 5/1993 | WIPO . | |

OTHER PUBLICATIONS

International Publication Number WO 93/12987; publication date 08, Jul. 1993; titled "Bag Dispensing System"; Inventor: Richard M. Wile.

*Primary Examiner*—David T. Fidel
*Attorney, Agent, or Firm*—Tobor & Goldstein, L.L.P.

[57] ABSTRACT

A dispenser for dispensing individual pre-formed bags from a stack of pre-formed bags has a body part and an anchor part for the stack of bags. The anchor part includes a catch means for engaging the stack, whereby the stack of bags depends from the catch means, and may be grasped for removal. A stack restraining member bears against the stack to restrain the stack of bags, but can be deflected against a gravitational restoring force when one side of the first bag of the stack is drawn past it to open the first bag for loading prior to removal from the stack.

19 Claims, 10 Drawing Sheets

DISPENSERS FOR BAGS, AND BAGS FOR USE THEREWITH

BACKGROUND OF THE INVENTION

1. Field of the Invention

This invention relates to dispensers for dispensing individual pre-formed bags from a stack of such bags, and further relates to novel designs of bags for use with such dispensers.

2. Description of the Related Art

It is common practice to provide, for example in supermarkets and other retail outlets, dispensers for dispensing pre-formed bags (e.g. plastic bags) from a stack of such bags. A typical prior art system is illustrated in FIG. 1 of the accompanying drawings, which shows in perspective view from the front a stack of bags 1 being offered for initial loading onto the dispenser 2. The dispenser 2, which is formed of folded steel, comprises a body part 3 in the form of a frame, from which project forward two prongs 4 and associated outer guide members 5. For safety and to assist removal of the loaded bags, the prongs 4 preferably carry resilient tips 4', typically formed of plastic-coated springs. Half way between the prongs 4, and slightly below their level, there is provided a catch 5, in the form of a folded steel rod of U-configuration which projects slightly forwards from the frame part to which it is secured, and is turned upwards at the base of the U.

The stack of bags 1 comprises a central block 7 formed from tongue-like projections from each bag of the stack, the tongue-like projections being heat-bonded together to form the block. Each tongue is connected to its respective bag by two side webs 8, which can be easily broken, and between the side webs there is a slit 9. The block is provided with a through channel 10, which receives the catch 5 when the stack is loaded onto the dispenser (Arrow A). The engagement of the catch 5 with the block 7 generally anchors the stack of bags 1 to the dispenser 2.

The handle-providing parts 11 of the bags (herein called "handles" or "handle portions" for convenience) extend at each side of the stack 1, and are free from the handles of adjacent bags of the stack. Each handle 11 is provided with a through-hole so that the stack of bags has two further channels 12,13, passing through the stack, one through each of the handles. These two channels 12,13 each receive one of the prongs 4 of the dispenser (Arrows B and C).

According to the prior art system illustrated in FIG. 1, the prongs 4 are spaced further apart than the corresponding channels 12,13 in the handles of the stack 1 of bags in the normal flat condition of the stack. The result of this difference is that, to load the stack onto the dispenser, the handles 11 of the stack must be splayed outwards (see Arrows B and C). This splaying outwards of the handles to permit engagement of the prongs with the channels through the stack has the result that the stack of bags does not hang so deeply from the dispenser as it would do if the handles were not splayed out, and furthermore it keeps the handle portions of the bags out of the way, to assist the loading of articles of shopping into the bags.

The bags are removed from the dispenser one by one, by pulling the front bag of the stack forwards along the prongs 4, breaking the webs 8. Although adjacent bags of the stack are not attached to each other in the regions of the handles, a spot 14 of glue or other adhesive is normally placed between adjacent bags in the central region, just below the slit 9. The glue spot 14 is intended to cause the next bag on the dispenser to partially open when the front bag is removed from the dispenser, so facilitating loading of the next bag. The glue spot is intended to provide a relatively weak bond between adjacent bags, which will break easily when the front bag is pulled from the dispenser.

The prior art dispenser system described above is widely used, but nevertheless suffers from a number of well-recognised disadvantages, which have hitherto proved remarkably difficult to overcome by improved dispenser design. It is these problems which the invention aims at least in part to address and overcome.

More particularly, the loading of the stack of bags, and subsequent removal of individual bags, is awkward and time consuming. The splaying out of the handles to engage the stack with the prongs of the dispenser is at best awkward and at worst requires considerable muscular strength in the arms. It is a two-handed operation, and at the same time the weight of the stack of bags must be supported fully by the operative. Once the stack is initially loaded onto the prongs, it must be pushed to the back of the dispenser, and at that time it is necessary for the central catch 6 to be engaged in the channel 10 of the central block 7 of the stack. That final task in itself is not easy, and can result in breaking of some of the webs 8 connecting the block 7 to the bags, as mentioned above. This breakage of the webs impairs the intended function of the dispenser.

It is only feasible to manufacture stacks of about 50 such bags, due to the configuration of the central block 7. Thus, to load the intended complement of 500 bags onto a dispenser is a slow operation, which can cause delays and annoyance to customers and be tiring and annoying for checkout operatives (leading often to errors and carelessness in the loading procedure). It is known to preload the stacks of bags onto hollow tubes, which are slid over the prongs 4 and then removed to leave the stacks engaged on the prongs 4. However, this solution does not avoid the need to engage the central block 7 with the catch 5, does not lead to substantial time savings overall, is still generally awkward, and are normally only used with prior art dispensers in which the prongs 4 are rigid over their whole length, i.e. do not have resilient tips.

Even if the webs 8 are properly intact in the loaded stack of bags, their function, and the cooperative function of the flue spots 14, have never been particularly satisfactory. What often happens is that, when the front bag is removed from the dispenser, not merely the next bag but the next three or four bags are pulled forward along the prongs 4 and open up to some extent. This effect is generally known as "concertinaing" or "daisychaining". Thus, the checkout operative still has to manually arrange the front bag before it can be used for the next customer.

A further difficulty with the prior art system lies in the awkwardness of the configuration as far as the checkout operative or customer is concerned. The bags are hung vertically from horizontal prongs 4. In many cases this means that the bottom of the front bag, as hanging on the dispenser, is lower than the checkout counter, meaning that the checkout operative or customer has to awkwardly lift possibly heavy items in a back-bending, stretching and twisting movement, before putting them into the bag. Furthermore, after loading of the front bag, the whole bag, full of heavy shopping, has to be pulled horizontally forward along the prongs with the splayed handles 11 stretched tightly sideways, then detached from the dispenser and presented to the customer. These actions, repeated many times during a day, are extremely tiring for checkout operatives, and are potentially damaging to health and fitness in the long-term. Even if the work is done by a customer, such an operation can be difficult and tiring for inexperienced or inform people. At the very least, the prior art dispenser design causes additional difficulties in an already tiring job, and does not assist checkout operatives to bag items in a well-presented and efficient manner.

There is thus a perceived need for an improved dispenser for dispensing pre-formed bags at points of use.

SUMMARY OF THE INVENTION

In accordance with a first aspect of the present invention there is thus provided a dispenser for dispensing individual pre-formed bags from a stack of such bags, the dispenser comprising a body part and an anchor part for the stack disposed on the body part, the anchor part comprising catch means for engaging a stack of pre-formed bags whereby the stack depends from the catch means for being grasped for removal, and a stack restraining means comprising an elongate member associated with the dispenser and movable between a first position in which the elongate member rests alongside or bears against the stack to restrain the same and a second position in which the elongate member is deflected from its first position against the action of a restoring force to permit one side of a first bag of the stack to be drawn past the stack restraining means to open the said first bag for loading prior to removal from the dispenser.

The elongate member of the stack restraining means is thus able, after deflection to allow the one (leading) side of the first (top) bag of the stack to be drawn past the stack restraining means, to return to its first position in which the stack restraining means then rests alongside or bears against the trailing side of the said bag (and the underlying other bags of the stack) as the mouth of the first bag opens, to keep the mouth of the bag open for loading, prior to removal from the dispenser.

It is preferred that the dispenser further comprises stack support means for underlying and supporting a portion of the engaged stack and the stack restraining means bears against the engaged stack.

In accordance with a second aspect of the present invention there is thus provided a dispenser for dispensing individual pre-formed bags from a stack of such bags, the dispenser comprising a body part and an anchor part for the stack disposed on the body part, the anchor part comprising catch means for engaging a stack of pre-formed bags and stack support means for underlying and supporting a portion of the engaged stack, wherein the anchor part is adapted to have the stack of pre-formed bags that is engaged with the catch means pass over the support means for being grasped for removal, and a stack restraining means is further present, which bears against the engaged stack to retrain the stack to the support means while permitting one side of a first bag of the stack to be drawn past the stack restraining means to open the said first bag for loading prior to removal from the dispenser.

It is most preferred that the said drawing of one side of the first bag of the stack past the stack restraining means to open the bag for loading is accomplished, via a glue spot or similar region of adhesion between adjacent bags of the stack, by the act of removal of the previous bag from the dispenser.

In one particularly preferred form of the invention, the catch means is a relatively large central hook or folded metal plate, which is received in a large central through-channel of the stack of bags. Preferably this comprises the sole means for engagement of the dispenser with the stack of bags. The stack can be of the conventional construction, in which the pairs of handles of the individual bags of the stack are bridged by a web of plastic connected to the handle portions at each end by lines of weakness (e.g. defined by perforations), the bridging webs being held together (e.g. by heat-bonding, taping, wrapping, clipping and/or tying) to form a so-called block header. Alternatively, and more preferably, the novel modified design of such stacks according to the invention may be used, as described in more detail below.

The anchor part may be integral with, or fixedly disposed on, the body part. The body part suitably comprises a base part, mounted e.g. on a checkout counter or the like, from which the anchor part upwardly extends, the catch means being provided relatively far from the base part and the arrangement being such that in use the stack of bags depends from the catch means.

If the bags are long, they may hang down through a hole provided in the base part and/or any checkout counter on which the dispenser is mounted. In that case, a rim or lip is preferably provided, onto which the bottom of the first bag of the stack can be rested at checkout counter level, during the operation of loading the bag with items of shopping. In this way, the need for persons to bend, stretch and twist in order to load the bags with shopping is considerably reduced, compared with the prior art system.

The stack support means, when present, is suitably adapted to support the engaged stack of bags across substantially the whole width of the stack. The stack support means may, for example, comprise a support plate, mounted to the body part of the dispenser. The stack support means is suitably adapted to support the stack at an angle to the vertical, e.g. 5°–85°, preferably approximately 20°–60°. The catch means conveniently extends upwardly from the stack support means. The catch means may be arranged such that the stack of bags in the region of the catch means lies horizontal and the bags of the stack lie for the major portion of their length at an angle to the vertical, corresponding to the configuration of the support means.

The stack support means, when present, preferably has side portions which turn up at an angle to the perpendicular from the plane of the stack support means, e.g. between 20° and 70°, most preferably about 35°–55°, which cause the stack of bags to be supported with the sides of the bags turned somewhat upwards in a bowed arrangement. In this way, when one side of a bag of the stack is opened by the operation of the dispenser, as will be described in more detail below, the other side of the bag, restrained by the restraining means, adopts the correct configuration for defining a rounded, open, mouth of the bag. The configuration of the bag is thus effectively a tube, resulting in much easier loading of articles of shopping into the bag.

The stack restraining means suitably comprises a relatively heavy restraining member which is hinged to the anchor part of the dispenser in such a way that it can rest alongside or bear against the stack of bags in the region of the bag mouths under the influence of a grativational restoring force. Where the stack support means are present, the stack restraining means will thus urge the bags towards the stack support means. Where stack support means are absent, the stack restraining means typically hang alongside the hanging stack of bags. When a bag is removed from the stack, the restraining means lifts to accommodate this movement, and then falls back to restrain the next bag of the stack. Furthermore, when the region of adhesion between the bag being removed and the next bag of the stack causes the leading side of the said next bag to be drawn past the stack restraining means to open the mouth of the said next bag, the restraining means will similarly fall to restrain the trailing side of the said next bag, so preventing the concertina effect found with the prior art dispensing system described above. The restraining member is suitably hinged to the catch means, and most preferably is articulated to comprise first and second restraining member portions hinged mutually together. The first and second portions are suitably of different size and weight compared with each other. The portion hinged to the catch means is preferably the larger portion, and can provide the inertia to rest alongside or bear against the stack; the second portion, which typically takes the form of a lighter tongue hinged to the free end of the first portion, but may alternatively be the heavier portion, bears particularly against the trailing side of the bag to be removed, most preferably on the rim of the mouth of the bag, in such a way as to offer enough restraining to assist in opening the mouth of the bag.

In addition, by articulating the restraining member, and more particularly by preferably providing the second restraining member portion with a stop-tongue extending from the articulation hinge in a direction opposite to the second restraining member portion, and lying under the first restraining member portion, the restraining member can bear squarely against the stack at all times curing consumption of a stack of bags, i.e. when the stack is new and thick and when the stack is very much thinner.

In a preferred form of the invention, the restraining member of the stack restraining means is hinged to the anchor part of the dispenser via a longitudinally variable hinge, whereby the hinge can move along a defined path according to the number of bags being held in the dispenser. The hinge is most conveniently a slot and pin hinge arrangement in which the hinge pin is retained in a vertical or angled elongate slot along which it can slide freely to and fro. The arrangement is such that the restraining member always lies as close as possible to the stack of bags, maintaining as close a restraint as possible, by virtue of the hinge pin tending to rest as low as possible in the slot under the influence of gravity at all times during consumption of the stack.

It is preferred that the bags are made to a novel design which will now be described in more detail.

Stacks of plastic bags are well known, in which the handle portions of each bag are bridged by bridging webs of plastic, connected to the handle portions at each end by lines of weakness (e.g. defined by perforations). The bridging webs are held together (e.g. by heating-bonding, taping, wrapping, clipping and/or tying) to form a so-called block header between the handle portions of the stack. This provides a large through-channel in the stack in the region of the mouths of the bags.

While such a known configuration of stack may be used in connection with the apparatus of the present invention, our research has shown that detachment of such bags from the stack is not ideal, and in another aspect the present invention aims to improve the design of such stacks and consequently the manner of dispensing of individual bags from the dispenser of the invention.

In accordance with a further aspect of the present invention, therefore, there is provided a stack of pre-formed bags for use with a dispenser according to the first aspect of the invention, each bag of the stack, when lying flat in the stack, comprising a bag portion and two side handle portions extending therefrom, the handle portions being bridged by bridging webs of a block header connected between the handle portions via lines of weakness at each end of the bridging webs, wherein the block header is connected to the handle portions over at least substantially 25 percent of the lengths of the handle portions as measured in a direction away from the bag portion, and/or the block header is not connected to the handle portions over substantially the last five percent of the lengths of the handle portions as measured in a direction away from the bag portion. It is to be noted that, because the handles are flattened in the stack, the length of each handle portion of the stack represents only half of the length of the handle "bridge" when the bag is in use. In the following description, the top portion of the flattened handle as lying in the stack will be termed the "front part" and the lower portion the "rear part". These correspond to the leading and trailing sides respectively of the bags of the stack.

The said further aspect of the present invention covers also the individual bags of the novel stack and methods for manufacturing the individual bags and the novel stack. More particularly, the individual bags comprise the bag and handle portions and the bridging webs as defined above for the novel stack, wherein the bridging webs are connected to the handle portions over at least substantially 25 percent of the lengths of the handle portions as measured in a direction away from the bag portion, the bridging webs if necessary being suitably shaped to provide the required through-channel in the bags in the region of the mouths of the bags, and/or the bridging webs are not connected to the handle portions over substantially the last five percent of the lengths of the handle portions as measured in a direction away from the bag portion. The individual bags are manufactured in generally conventional manner, and are subsequently held together at the bridging webs, preferably in stacks of up to about 500 bags, e.g. by heat-bonding, taping, wrapping, clipping and/or tying the bridging webs together to form the block header.

The lines of weakness preferably connect each bridging web of the block header to the respective handle portions over the majority of the length of the handle portions, for example between about 50 and 95% of the length of the handle. Where a block header is connected to the handle portions over a relatively large portion of the length of the handle portions, the header is suitably configured so as to still leave a relatively large through-channel in the stack, for receiving the catch means of the dispenser.

The stack of bags is preferably provided with at least one region of adhesion between at least one pair of adjacent bags. Preferably, at least one region of adhesion is provided between each adjacent pair of bags of the stack. The region (s) of adhesion may take the form of one or more line or spot of glue, suitably located between the bags near the mouths of the bags.

The region(s) of adhesion are preferably provided on tongues of bag material which are arranged to extend away from the bag portions in the central region between the handle portions, i.e. above the general line of the rims of the bags. Conventional glues or other adhesives, such as contact adhesives or hot-melt adhesives may suitably be used, and may be applied as spots or lines in conventional manner. The glue may suitably provide a resistance to breaking between the bags in the range of about 4 to 9 Newtons.

The stack of bags is manufactured in conventional manner according to the following steps:

(a) a cylindrical plastic film is obtained by blown-film extrusion through an annular die in conventional manner;

(b) the cylinder is closed by heat bonding to form a first and second seam at the top and bottom of each bag-forming length of film, and each individual bag-forming length is cut from the film cylinder;

(c) a die cutter is used to cut the two side handle portions so as to leave the bridging webs connected between the handle portions via lines of weakness;

(d) the individual bags and connected bridging webs are assembled in a stack with the adhesive being applied to the top bag of the growing stack before the next bag is laid on; and (e) the individual bridging webs are held together to form the block header, for example by hot pin bonding through the stack of bridging webs and/or wrapping the bridging webs together.

The die cutter is configured so as to provide the desired arrangement of the block header with respect to the handle portions, and/or of the rim of the bags in the region of the bag mouths.

By removing the connection between the block header and the handles at the ends of the handles, a surprisingly improved effect is obtained when the bags are removed individually from the dispenser of the invention. More particularly, when a bag is removed, any region of adhesion between its trailing side and the leading side of the next bag of the stack causes the leading side of the said next bag to open, which then causes the stack restraining means to lie in the mouth of the said next bag. Thus, the trailing side of the said next bag is restrained, whereas the leading side is free and is pulled for as long as the adhesion with the bag being removed is retained. The relatively wide catch means supports the block header across substantially all of its width. However, the lack of any resistance between the block header and the ends of the handle portions has the effect that the pulling force, transmitted through the adhesive bond to the leading side of the said next bag, imparts tension to the front part of the handle portions on each side of the stack. This tension will at this point cause the lines of weakness connecting the said front part of the handle portions on each side of the stack to the block header to break. The tension passes through the front part of the handle portions into the rear part of the handle portions. Because there is no resistance from the block header, the rear part of the end of each handle portion is pulled forward. It is this opening movement between the front and rear sides of each handle portion that permits the mouth of the next bag to open, prior to complete breakage of the adhesive bond between the front and next bag. Thus, when the adhesive bond is broken, and the bag being removed becomes completely detached, the mouth of the next bag is found to be opened in a surprisingly effective and convenient manner, with the trailing side of the mouth restrained at its rim to the remainder of the stack by the stack restraining means.

Furthermore, by providing that the lines of weakness between the block header and the handle portions of the bags extend over at least 25 percent of the lengths of the handles, preferably over the majority of the length of the handle portions, a further advantage is produced. As the mouth of the first bag is further opened, the lines of weakness between the block header and the rear part of the handle portion break from the end of the handle portion and the breaks travel down towards the bag portion. The relatively long lines of weakness along the length of the handle portions keep the handles attached to the block header for a relatively long period of time, so keeping the handles restrained and the bag mouth open for longer.

By providing a dispenser in which a large, single, catch is provided, which is easy to engage with a large central through-channel of a stack of bags, the loading operation is considerably simplified into essentially one simple operation, rather than many difficult operations as previously was the case. Moreover, the configuration of the dispenser and stack of the invention improves the operation of filling the individual bags of shopping.

BRIEF DESCRIPTION OF THE DRAWINGS

For a better understanding of the invention, and to show how the same may be carried into effect, reference will now be made, by way of example, to FIGS. 2 to 13 of the accompanying drawings, in which.

DETAILED DESCRIPTION OF THE INVENTION

Figure 1:
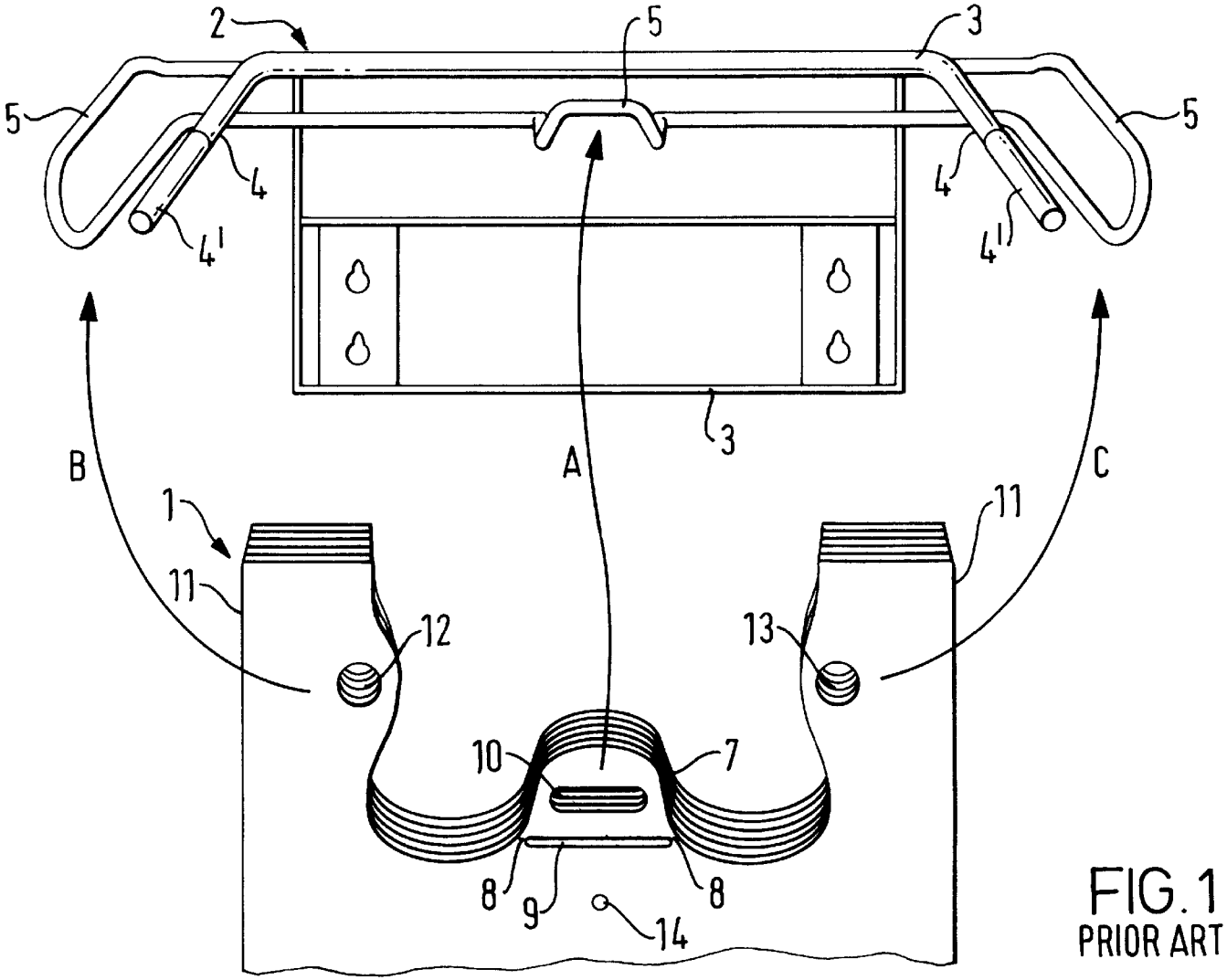
FIG. 1 PRIOR ART
FIG. 1 shows a "Prior Art" dispenser.
Figure 2:
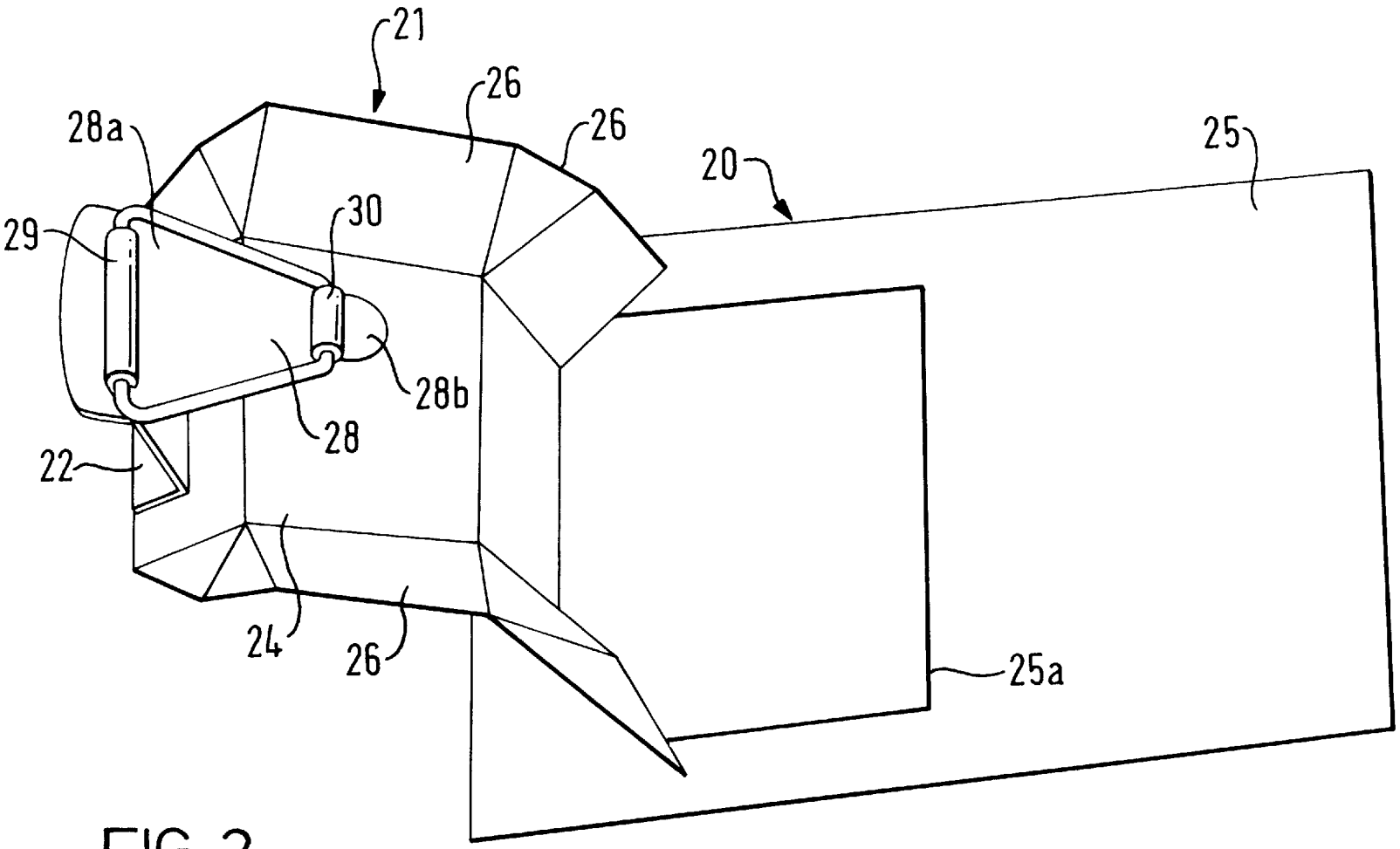
FIG. 2 shows a top perspective view of a dispenser for dispensing individual pre-formed bags from a stack of such bags, but omitting the stack of bags for clarity.
Figure 3:
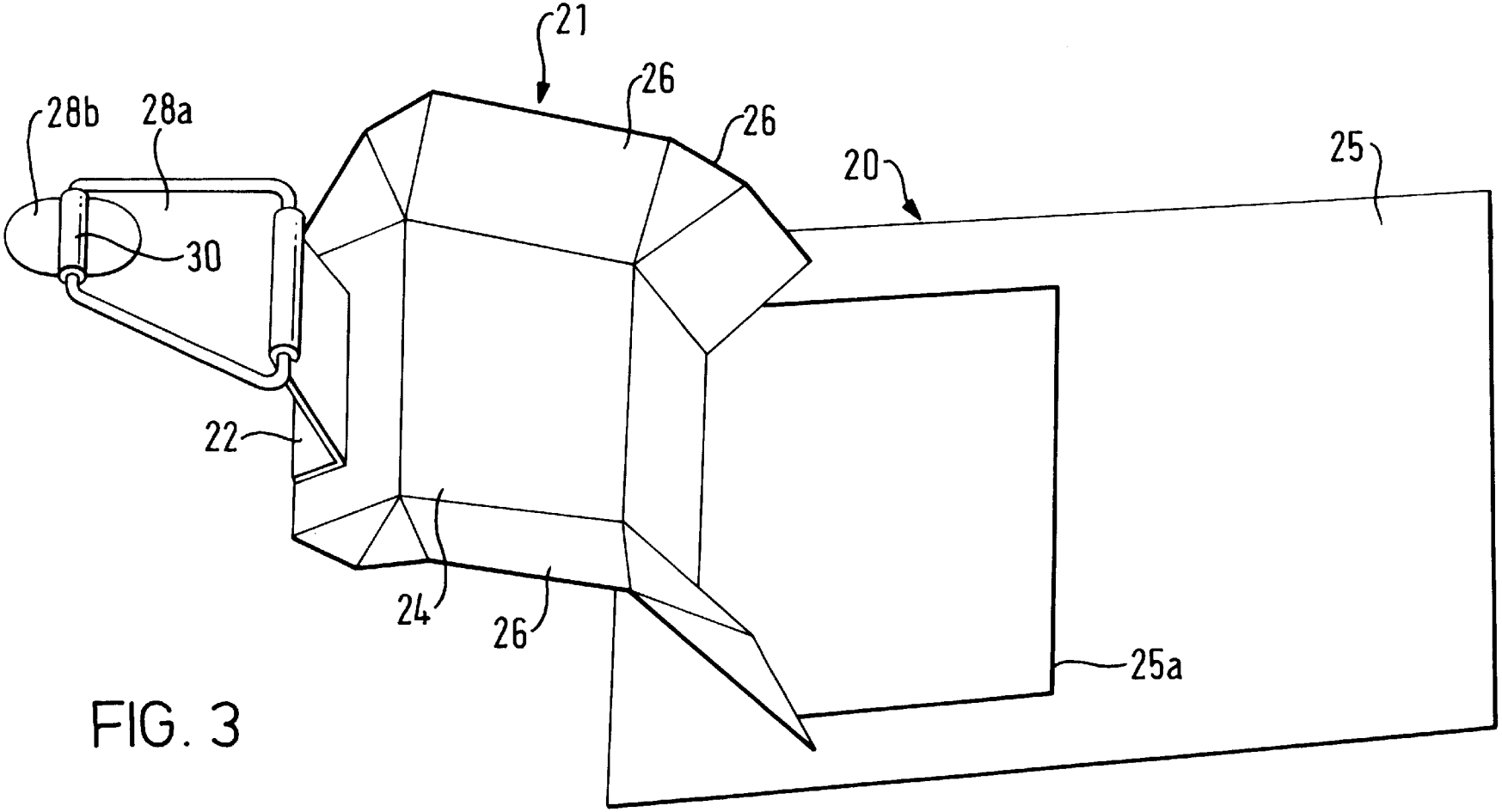
FIG. 3 shows the dispenser of FIG. 2 in position for loading a stack of bags.
Figure 4:
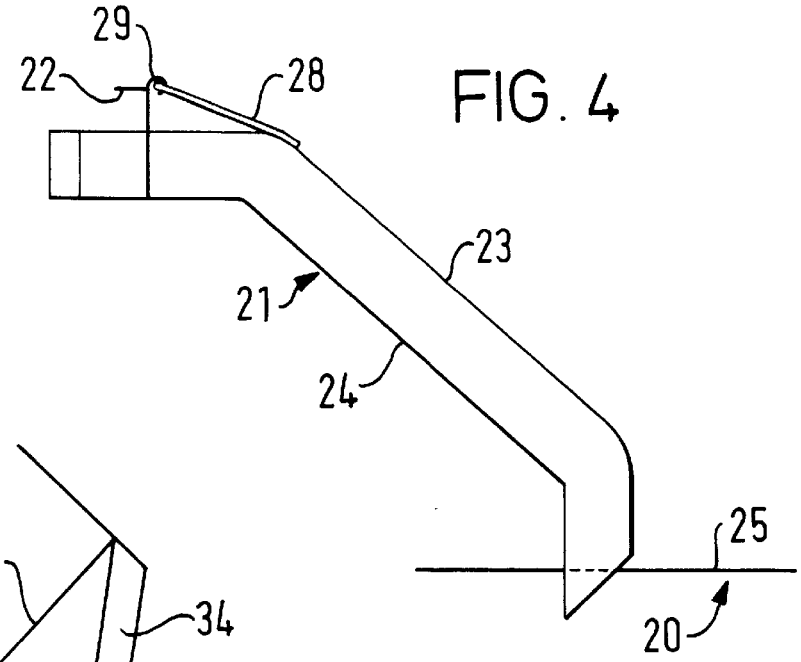
FIG. 4 shows a schematic side view of the dispenser of FIG. 2, after loading of a stack of bags.

Referring to FIGS. 2 to 4, there is shown a dispenser for dispensing individual pre-formed bags from a stack of such bags, the dispenser comprising a body part 20 and an anchor part 21 for the stack. The anchor part is integral with, or fixed to, the body part, the whole being constructed in sheet metal.

The anchor part 21 comprises catch means 22 for engaging a stack 23 of pre-formed bags and stack support means for underlying and supporting a portion of the engaged stack 23.

The body part 20 comprises a base plate 25, which in use is affixed to a supermarket checkout counter or the like. The stack support means comprises a support plate 24 mounted above the base plate of the dispenser at an angle of approximately 40° to the vertical. The catch means 22 extends upwardly from the support plate, in a region of the support plate 24 which is turned to lie horizontally, so that the stack of bags in the region of the catch means 22 lies horizontal and the bags of the stack lie over most of their length at an angle to the vertical, corresponding to the configuration of the support plate (see FIG. 4).

To allow the dispenser to accommodate relatively long bags, a hole is provided in the base plate below the stack support means, and a corresponding hole would be cut into the supermarket checkout counter, so that the stack of bags can hang down into the hole (see FIGS. 2 to 4). A rim 25*a* of the base plate 25 (or a corresponding rim of the checkout counter or the like) can support the front bag of the stack while it is being loaded with items of shopping, thereby maintaining the bottom of the bag at counter level and enabling shopping to be loaded into the bag by a person with considerably reduced back and body strain.

The stack support plate 24 is generally adapted to have the stack of pre-formed bags that is engaged with the catch means pass over the support plate for being grasped for removal. More particularly, the first (upper) bag of the stack can readily be grasped by the checkout operative, either at its lower end or along its length or side.

The stack support plate 24 is adapted to support the engaged stack of bags 23 across substantially the whole width of the stack. Furthermore, side portions 26 of the support plate 24 turn up at an angle of about 45° to the perpendicular from the plane of the support plate. The upturned side portions 26 cause the stack of bags to be supported with the sides of the bag turned correspondingly upwards in a bowed arrangement. In this way, when one side of the first bag of the stack is opened by the operation of the dispenser, as will be described in more detail below, to open the gusset of the bag and preferably to support the bottom of the bag on the rim 25*a* of the base plate 25, the other side of the bag adopts the correct configuration for defining a rounded, open, mouth of the bag.

The catch means 22 is a folded metal plate, located generally centrally at the upper end of the support plate. This folded metal plate is received in a large central through-channel of the stack of bags, as will be described in more detail below.

The dispenser further comprises a stack restraining means which bears against the engaged stack of bags (see FIG. 4) to restrain the stack to the support plate. The stack restraining means is adapted to permit one side of a first bag of the stack to be drawn past the stack restraining means to open the bag prior to removal from the dispenser. This effect is accomplished by constructing the stack restraining means as a relatively heavy restraining member 28, in the form of a metal plate, which is hinged to the catch means via hinge 29 in such a way that the restraining member can bear down on the engaged stack of bags 23 in the region of the bag mouths, urging the bags towards the support plate 24.

The detailed configuration of the restraining member can be seen with particular reference to FIGS. 2 and 3. More particularly, the restraining member is articulated and comprises first 28*a* and second 28*b* restraining member portions hinged mutually together by hinge 30. The first portion 28*a* is substantially larger and heavier than the second portion 28*b*, which second portion takes the form of a relatively light tongue of the restraining member. The restraining member is configured so that the second portion 28 bears onto the stack of bags in the region of the rim of the mouth of the bags, as will be described in further detail with reference to FIGS. 10 to 13.

The second restraining member portion 28*b* is provided with a stop tongue 31, which extends away from the hinge 30 in a direction opposite to the second restraining member portion 28*b*, to lie under the first restraining member portion 28*a*. In addition to functioning as a stop, to ensure that the tongue of the second restraining member portion 28*b* bears generally flat against the stack of bags, this stop tongue 31 serves to enlarge the area of the restraining member 28 that bears squarely against, and in contact with, the stack, at all times during consumption of the stack of bags.

Referring now to FIGS. 5 to 8, an alternative dispenser is shown, in which like parts are designated as for FIGS. 2 to 4. The body part 20 comprises a pair 20*a*, 20*b* of plates integral with, or fixed to, the anchor part 21 for the stack, the whole being constructed in sheet metal.

Figure 6:
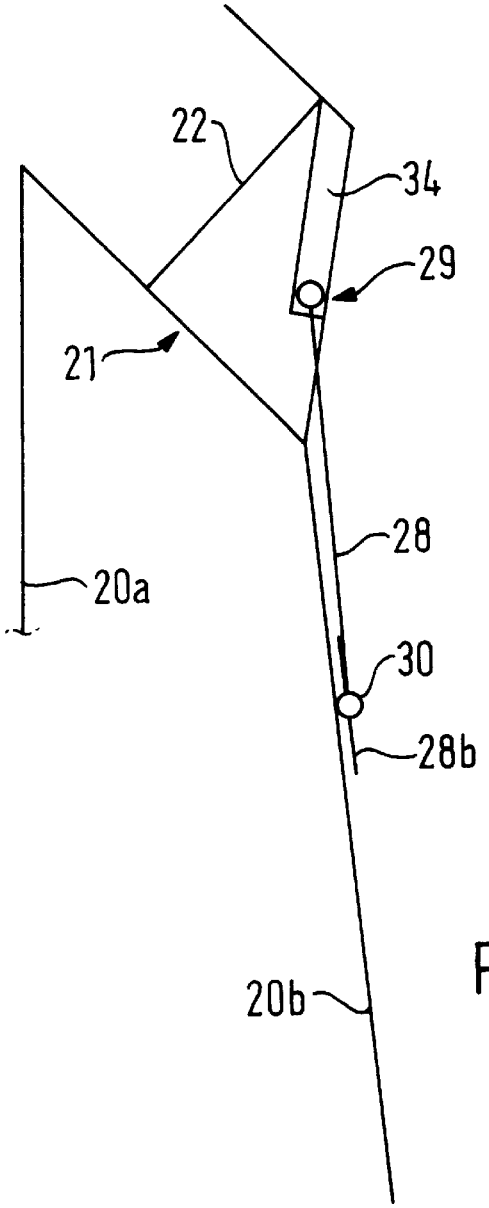
FIG. 6 shows a schematic side view of the dispenser of FIG. 5.
Figure 7:
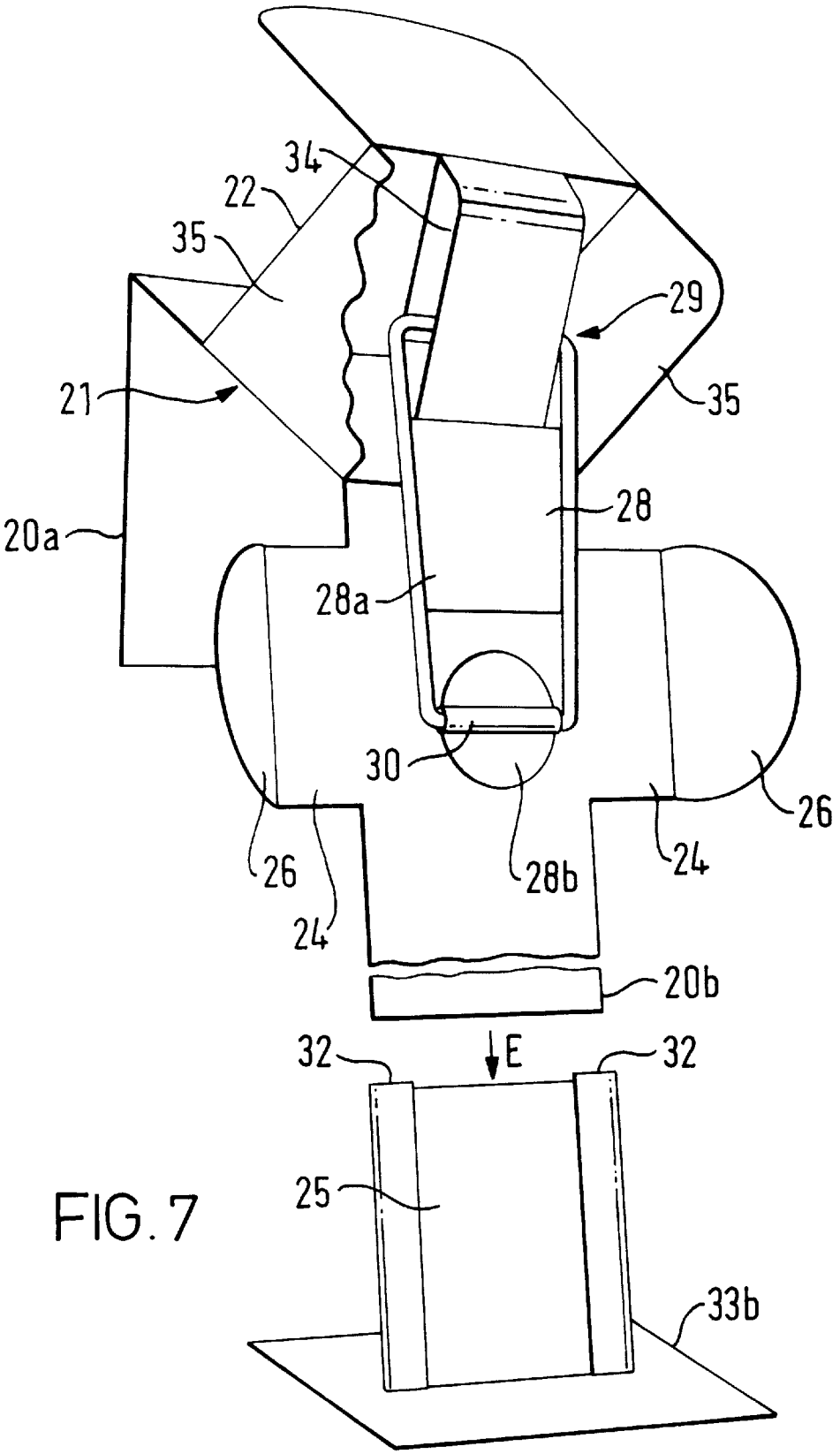
FIG. 7 shows a front perspective view of the dispenser of FIG. 5 mounted in the second alternative orientation.
Figure 8:
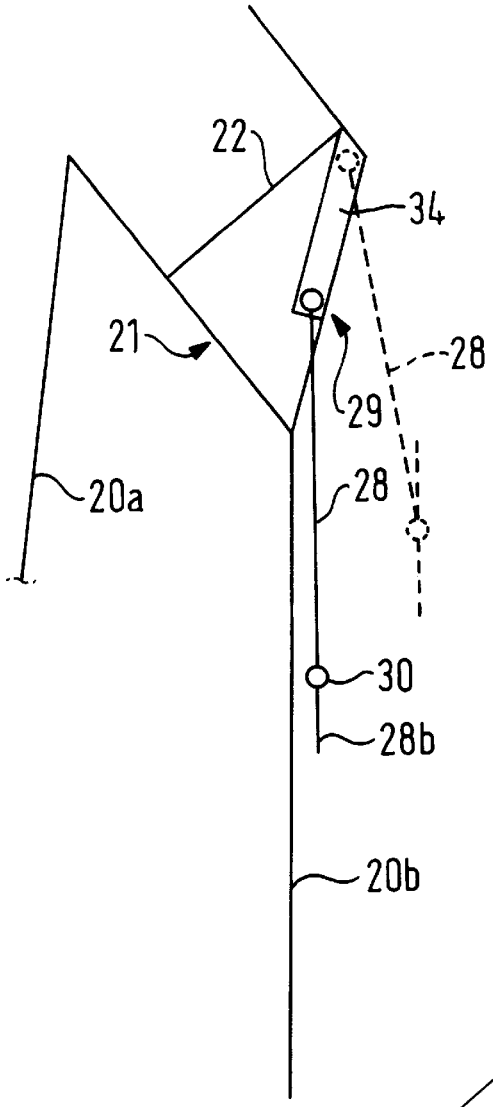
FIG. 8 shows a schematic side view of the dispenser of FIG. 7.

Plates 20*a* and 20*b* both depend from the anchor part 21, but at slightly different angles, as shown more clearly in FIGS. 6 and 8. Each plate is adapted to be received in mutually inwardly directed side channels 32 provided on a base 25, which in FIG. 5 is mounted vertically above a first fixed support structure 33*a* of conventional construction and in FIG. 7 is mounted vertically above a second fixed support structure 33*b*, again of conventional construction.

Figure 5:
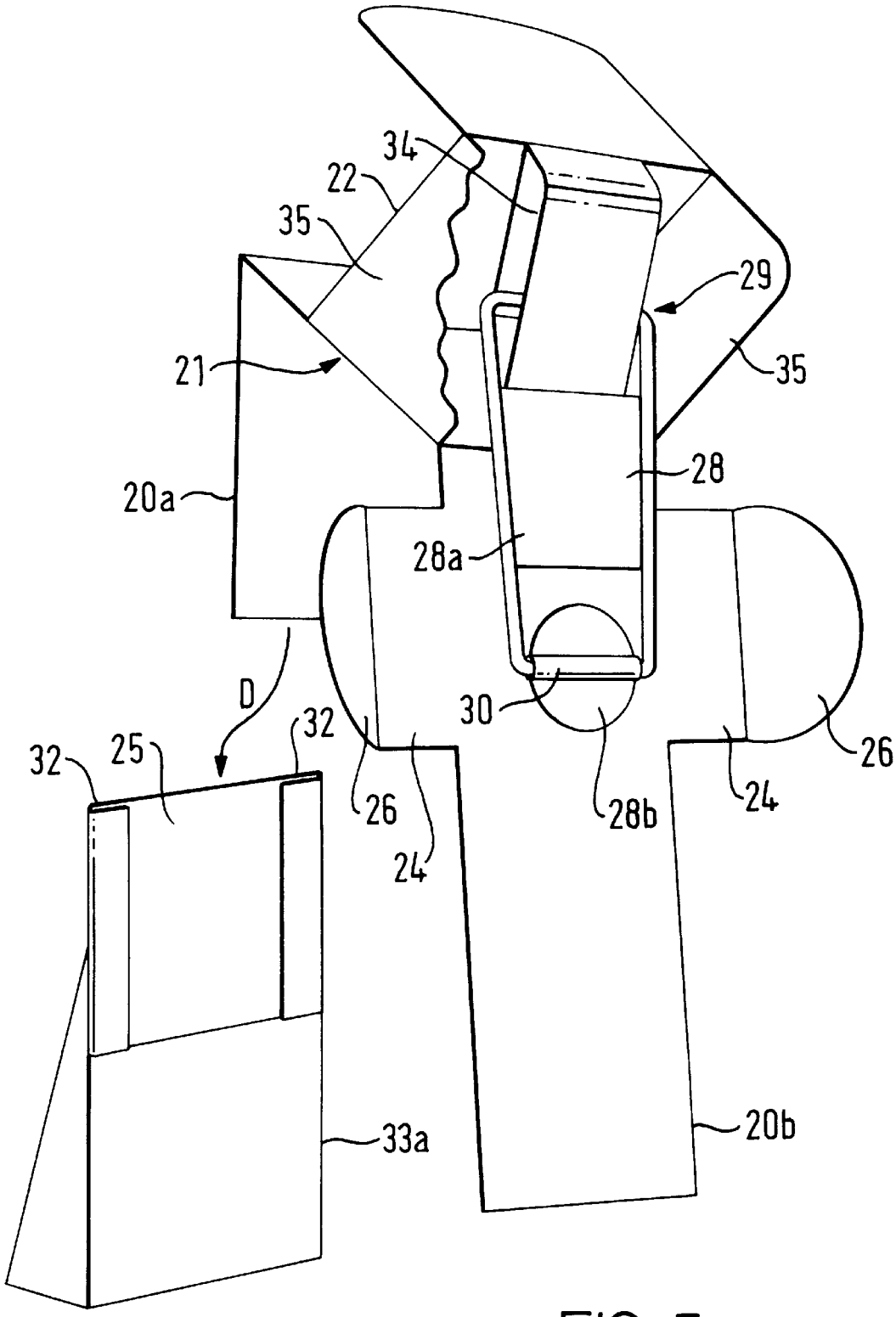
FIG. 5 shows a front perspective view of an alternative dispenser for dispensing individual pre-formed bags from a stack of such bags (but omitting the stack of bags and with part of the dispenser cut away for clarity), the dispenser mounted in a first of two alternative orientations.

In a first orientation, shown in FIGS. 5 and 6, the dispenser is mounted to the base 25 by engagement of the first plate 20*a* with the channels 32 of base 25 (see Arrow D), whereby the stack support plate 24 lies at an angle to the vertical in an arrangement corresponding generally to FIG. 4 (but with a somewhat steeper angle of inclination).

In a second alternative, orientation, shown in FIGS. 7 and 8, the dispenser is mounted to the base 25 by engagement of the second plate 20*b* with the channels 32 of base 25 (see Arrow E), whereby the stack support plate 24 rests in the vertical condition with no stack supporting function, but instead providing a fixed back stop for the stack of bags, against which the stack restraining member 28 bears under the effect of gravity.

The hinge arrangement 29 of the dispenser of FIGS. 5 to 8 differs from that of the dispenser of FIGS. 1 to 4 in an important respect. Instead of being journalled in a conventional tube (as in FIGS. 1 to 4), the hinge pin is journalled in an elongate slot 34 formed of folded metal plates. The slot 34 lies generally vertically, but angled so that its top overhangs its bottom to the front, irrespective of whether the dispenser is in its first (FIG. 6) or second (FIG. 8) orientation.

The hinge pin of the restraining member 28 is freely slidable to and fro along the slot 34. By selecting an appropriate slot length and angle of inclination, the restraining member 28 continuously adapts its orientation with respect to the stack of bags, as the bags are consumed, typically sliding gradually down the slot 34 in the process. This is shown in FIG. 8 as an example; the dotted lines represent the position of restraining member 28 when the dispenser is fully loaded with a stack of bags, whereas the solid lines represent the position of the restraining member 28 when the stack has been consumed.

The dispenser shown in FIGS. 5 to 8 also differs from the dispenser shown in FIGS. 1 to 4 in the minor variation of having structural bracing plates 35 extending to the front of the catch means 22. One of these bracing plates 35 is shown partially cut away in FIGS. 5 and 7, for clarity, and are omitted from the schematic views of FIGS. 6 and 8, again for clarity.

Figure 9:
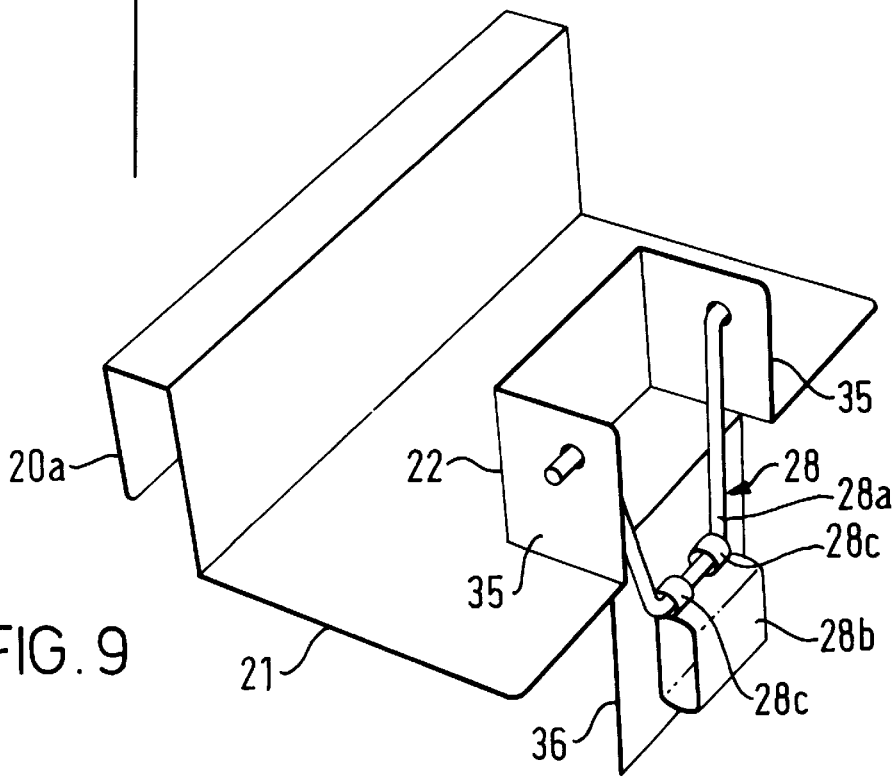
FIG. 9 shows a front perspective view of an alternative dispenser for dispensing individual pre-formed bags from a stack of such bags (but omitting the stack of bags for clarity)

FIG. 9 shows an alternative, simplified dispenser, somewhat similar in principle to the embodiment shown in FIGS. 5 to 8. Corresponding reference numerals are used in FIG. 9.

The dispenser of FIG. 9 has a rear plate 20*a* integral with, or fixed to, the anchor part 21 for the stack, the whole being constructed in sheet metal. The rear plate 20 is adapted to hook onto a suitable fixture, for example part of a checkout counter or the like.

The catch means 22, which is provided with side bracing plates 35, extends up from the anchor plate.

The hinge arrangement of the restraining member 28 is fixed, unlike the longitudinally variable hinge of FIGS. 5 to 8. Furthermore, the first restraining member portion 28*a* of the restraining member 28 is a simple folded metal rod, of generally U-shape with out-turned ends. The out-turned ends rotatingly engage in holes provided in the side bracing plates 35, to constitute the hinge between the restraining member 28 and the dispenser.

The second restraining member portion 28*b* is hinged to the U-shaped first portion 28*a* by a pair of metal bands 28*c* encircling the first portion 28*a* at a straight portion at the base of the U. In this way the second restraining member portion 28*b*, which is somewhat heavier than the first portion 28*a*, is articulated to the first portion and hangs vertically from it.

To load a stack of bags, the restraining member 28 is first moved to an upward orientation, and then the stack of bags is engaged with the catch means 22, the stack passing over the restraining member before engaging with the catch means. The restraining member 28 is then allowed to drop to bear against the first bag of the stack, in a manner corresponding to FIG. 8.

A support plate as such is absent, and the engaged stack of bags hangs down from the catch means, with the restraining member 28 bearing against, and/or resting alongside, the first bag of the stack. However, there is provided a back plate 36, depending vertically below the catch means 22, which provides a back stop to maintain the engaged stack of bags in the generally vertical orientation.

Figure 10:
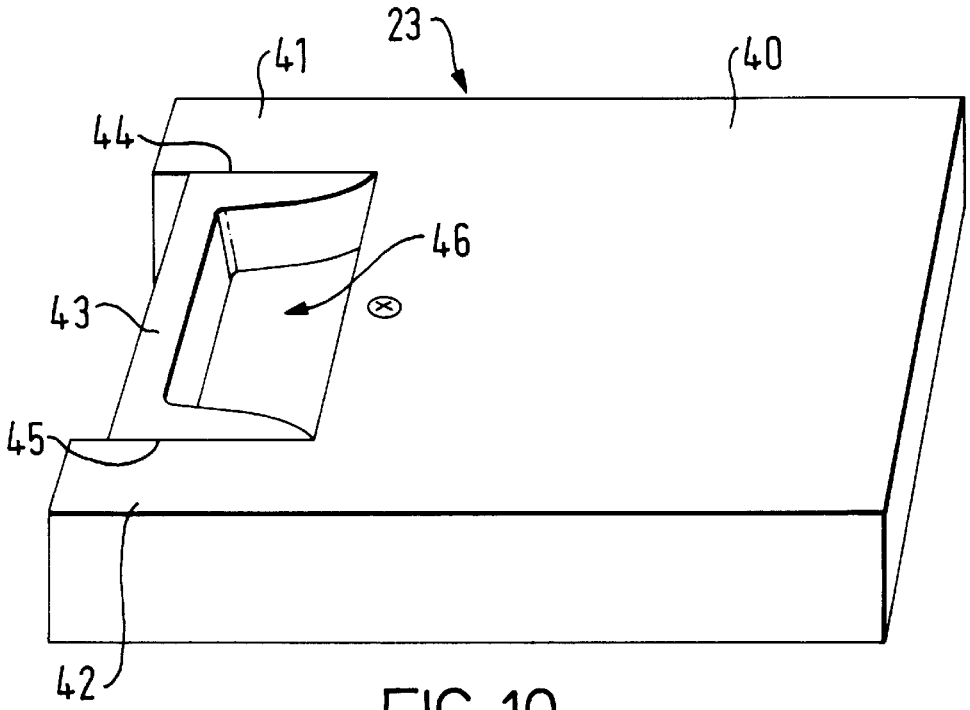
FIG. 10 shows a stack of bags constructed in accordance with the invention.
Figure 11:
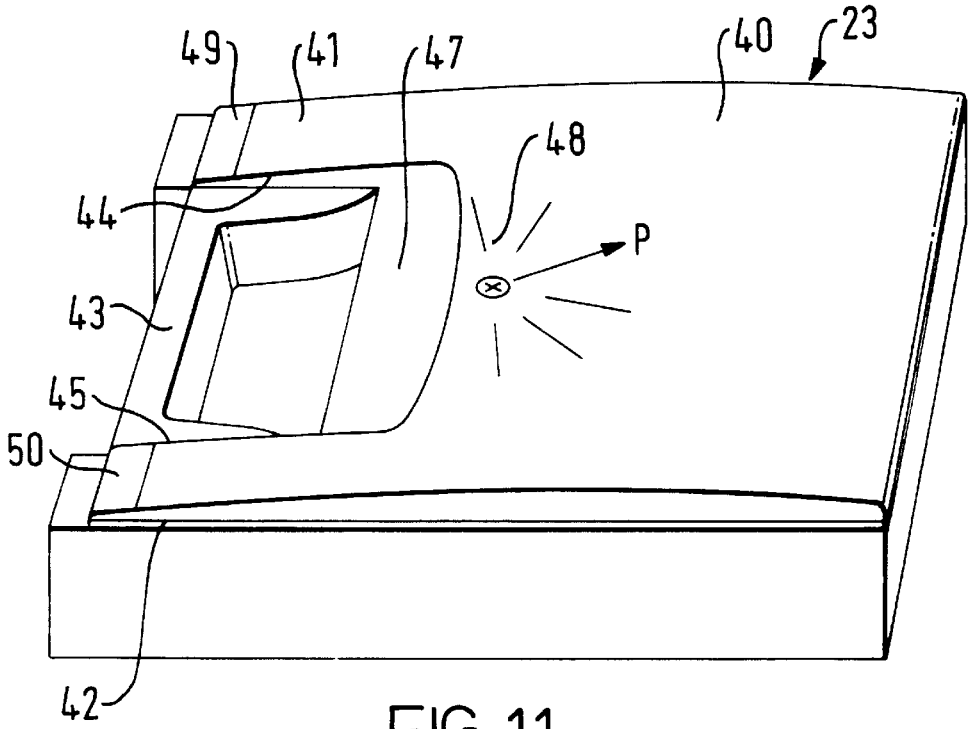
FIG. 11 shows the stack of FIG. 10 with the first bag of the stack being removed.

Referring now to FIGS. 10 and 11 in particular, and also generally to FIGS. 1 to 9, there is illustrated a stack 23 of pre-formed (e.g. plastic) bags for use with dispensers of the type described above. Each bag of the stack, when lying flat in the stack, comprises a bag portion 40 and two side handle portions 41,42 extending therefrom. The handle portions 41,42 are bridged by bridging webs of a block header 43 connected between the handle portions via lines of weakness 44,45 at each end of the bridging webs.

The block header 43 is not connected to the handle portions 41,42 at the ends of the handle portions 41,42 as measured in a direction away from the bag portion 40.

It is to be noted that, because the handles of each bag are flattened in the stack, the length of each handle portion 41,42 of the stack represent only half of the length of the handle "bridge" when the bag is in use. In the following description, the top portion of the flattened handle as lying in the stack 23 will be termed the "front part" and the lower portion of the flattened handle will be termed the "rear part".

The block header 43 is configured so that the lines of weakness 44,45 connect the block header to the handle portions 41,42 over the majority of the length of the handle portion.

The stack 23 of bags is provided with a region of adhesion between each pair of adjacent bags (not shown). The region of adhesion takes the form of a spot of glue located between the bags near the mouths of the bags, in the region marked X in FIGS. 10 and 11. Conventional glues such as contact adhesives are used, and are applied as spots in conventional manner. The manufacturing process is described below in more detail with particular reference to FIGS. 14 and 15.

Furthermore, the block header 43 is configured so as to leave a relatively large through-channel 46 in the stack 23, for receiving the catch means 22 of the dispenser.

To load the stack 23 of bags onto the dispenser the stack restraining means 28 is lifted into the substantially vertical upright position and the stack restraining means 28 and catch means 22 pass through the through-channel 46 of the stack, to engage the stack of bags on the catch means 22. By providing a dispenser in which a large, single, catch is provided, which is easy to engage with a large central through-channel of a stack of bags, the loading operation is considerably simplified compared with prior art systems.

Once the stack of bags is in plate it is allowed to rest on the support plate 24 and the stack restraining means 28 is moved into the operative position in which it bears against the stack at approximately region X, i.e. near the rims of the mouths of the bags. The dispenser is now ready for use.

The first bag of the stack is opened by hand and may, in the case of the dispenser shown in FIG. 2, be moved to stand with its bottom part on the rim 25*a* of the base of the dispenser. The restraining means 28 restrain the trailing side of the bag to the remainder of the stack, roughly in the location of region X (e.g. the glue spot between the adjacent bags). The first bag is then loaded with items of shopping, whereupon it is pulled from the dispenser to leave the next bag ready for use. Alternatively, the first bag can be pulled from the dispenser before loading.

By removing the connection between the block header 43 and the handles 41,42 of the stack of bags at the ends of the handle portions (as lying flat in the stack), a surprisingly improved effect is obtained when the bags are removed individually from the dispenser, as will now be described with particular reference initially to FIGS. 10 and 11.

When a bag is removed from the stack, the restraining means 28 lifts to accommodate this movement, and then fall back to restrain the next bag of the stack. This simple effect will happen with stacks of bags are used which have no intermediate region of adhesion between adjacent pairs of bags in the stack.

However, when stacks of bags are used which have regions of adhesion between individual bags, a more complicated effect is observed. When the region of adhesion between the bag being removed and the next bag of the stack causes the leading side of the said next bag to be drawn past the stack restraining means to open the mouth of the said next bag, the restraining means 28 similarly lifts to accommodate this movement but then falls back to restrain the trailing side of the said next bag, so preventing the concertina or daisychaining effect found with the prior art dispensers. Moreover, by removing the connection between the block header 43 and the handle portions 41,42 at the ends of the handle portions, an improved effect is obtained when bags are removed individually from the dispenser.

More particularly, when a bag is removed, the region of adhesion between its trailing side and the leading side of the next bag of the stack causes the leading side of the said next bag to open, which then causes the stack restraining means 28 to fall to lie in the mouth of the said next bag. For clarity, the bag being removed is not shown in FIG. 11. Thus, as illustrated in FIG. 11 (omitting the detail of the restraining means 28), the trailing side 47 of the said next bag is restrained in the region of its mouth by the action particularly of the second restraining member portion 28*b* bearing down on that part of the trailing side 47. However, the leading side 48 of the said next bag is free in the corresponding region of the mouth of the bag, and is pulled for as long as the adhesion with the bag being removed is retained. The relatively wide catch means 22 supports the block header 43 across substantially all of its width. However, the lack of any resistance between the block header 43 and the ends of the handle portions 41,42 has the effect that the pulling force P, transmitted through the adhesive bond X to the leading side 48 of the said next bag, imparts tension to the front part of the handle portions 41,42 on each side of the stack. This tension will at this point cause the line of weakness connecting the said front part of the handle portions 41,42 to the block header 43 to break. The tension passes through the front part of the handle portions into the rear part of the handle portions. Because there is no resistance from the block header 43, the end of the rear part 49,50 of each handle portion is pulled forward, so that the bag has the configuration shown in FIG. 11. At this point, resistance is met from the lines of weakness 44,45 connecting the rear part of the handle portions 41,42 on each side of the stack to the block header 43. However, by this stage, the mouth of the bag has opened considerably more than was possible with corresponding prior art systems. Furthermore, by using the dispenser of the present invention the bag is now restrained on its trailing side, and its trailing side is shaped in a bowed configuration by the upturned sides 26 of the support plate 24 (see FIGS. 2, 5 and 7).

Thus, when the adhesive bond X is broken, and the bag being removed becomes completely detached, the mouth of the next bag is found to be opened in a surprisingly effective and convenient manner, with the trailing side of the mouth restrained at the rim to the remainder of the stack by the stack restraining means. The next bag can then, if desired, be rested on the rim 25*a* for the next loading and removal cycle in the case of the dispenser shown in FIG. 2.

By providing that the lines of weakness 44,45 between the block header 43 and the handle portions of the bags extend over at least substantially 25%, and preferably over the majority, of the length of the handle portions, a further advantage is produced. As the arrangement shown in FIG. 10 is progressed further, towards complete detachment of the bag, the mouth of the bag is further opened, the lines of weakness between the block header and the rear part of the handle portion on each side break from the end of the handle portion 41,42 and travel down towards the bag portion 40. The relatively long lines of weakness 44,45 along the length of the handle portions 41,42 keep the handles attached to the block header 43 for a relatively long period of time, so keeping the handles restrained and the bag mouth open for longer.

When the lines of weakness 44,45 are finally broken, the trailing side of the bag will lift under continued pulling force, causing the restraining member 28 of the dispenser to lift and allow the bag to pass, whereupon the restraining member 28 will fall back to restrain the trailing side of the next bag of the stack while the cycle is repeated.

Figure 12:
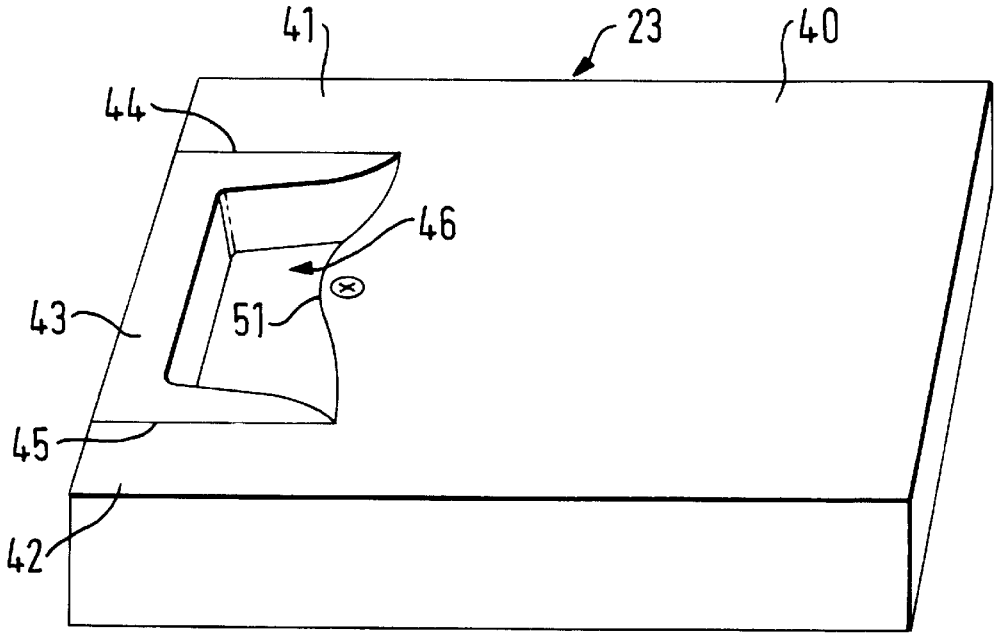
FIG. 12 shows an alternative stack of bags constructed in accordance with the invention.
Figure 13:
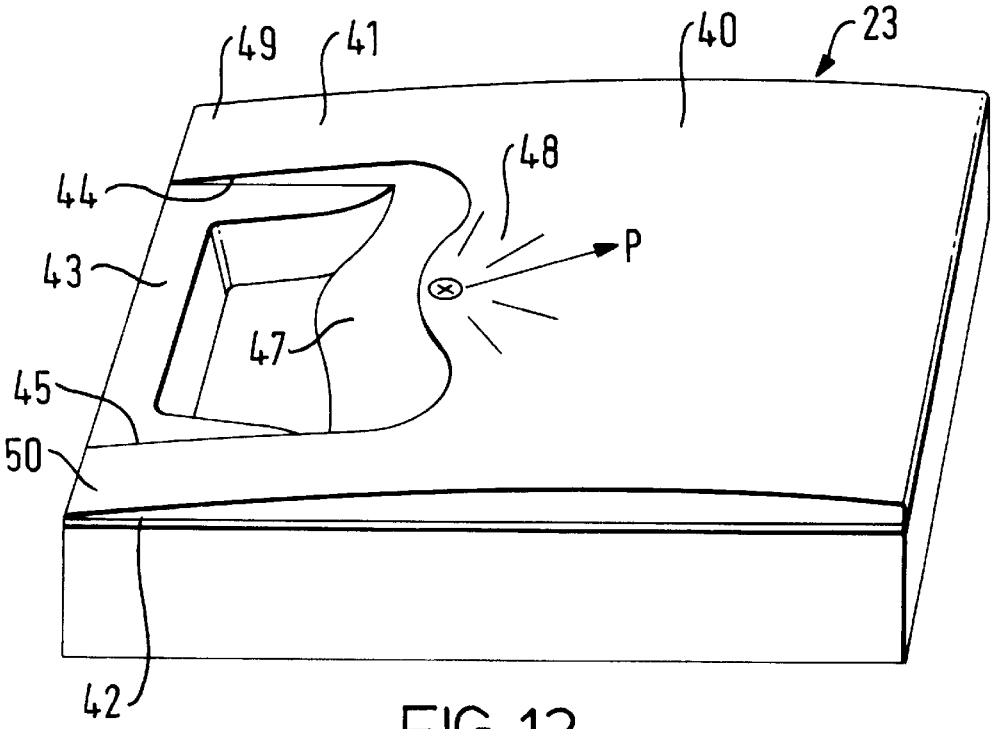
FIG. 13 shows the stack of FIG. 12 with the first bag of the stack being removed.

FIGS. 12 and 13 illustrate an alternative construction for a stack of bags 23, in which like parts are designated as for FIGS. 10 and 11. In the stack of FIGS. 12 and 13, the block header 43 is connected to the handle portions 41,42 right to the ends of the handle portions, i.e. not stopping short of the ends as in FIGS. 10 and 11. Furthermore, the region X of adhesive bonding between adjacent bags is provided on a small tongue 51 formed in the centre of the bags as lying flat in the stack, between the handle portions 41,42.

The stack shown in FIGS. 12 and 13 retain the advantages described above in providing that the lines of weakness 44,45 between the block header 43 and the handle portions of the bags extend over at least substantially 25%, and preferably over the majority, of the length of the handle portions, and furthermore the use of tongues 51 to carry the region X of adhesive bonding reduces the tension imparted to the handle portions of the bags during the dispensing operation, as the tongues themselves take up most of the tension as a bag is removed.

Figure 14:
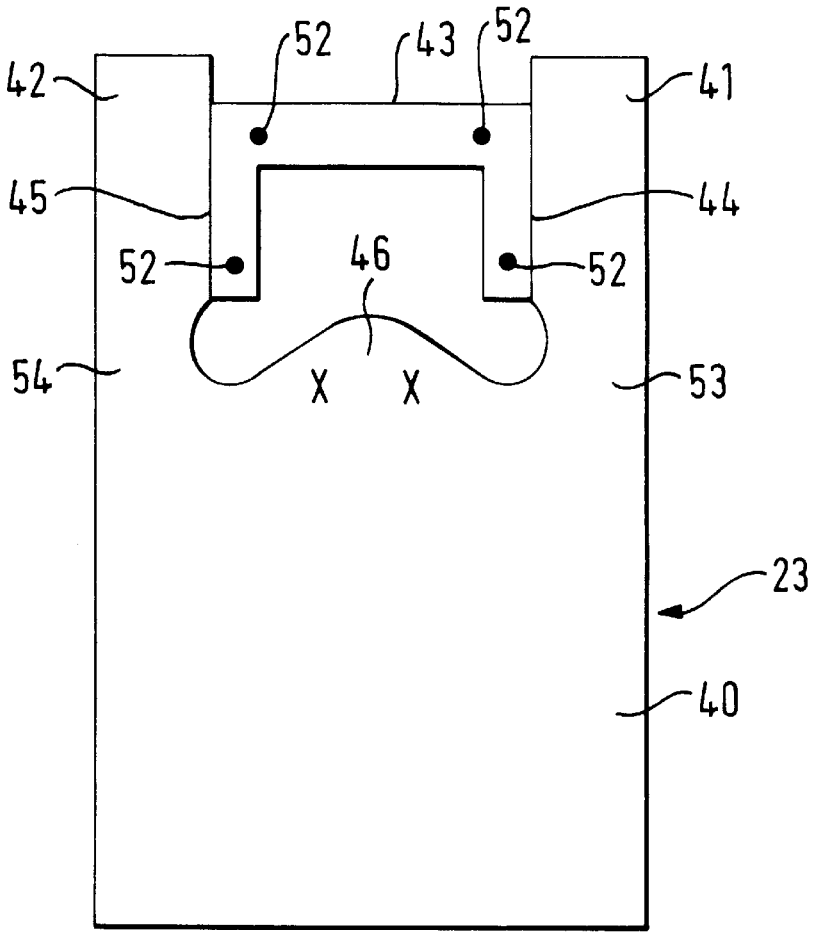
FIG. 14 shows in plan view an alternative stack of bags constructed in accordance with the invention.
Figure 15:
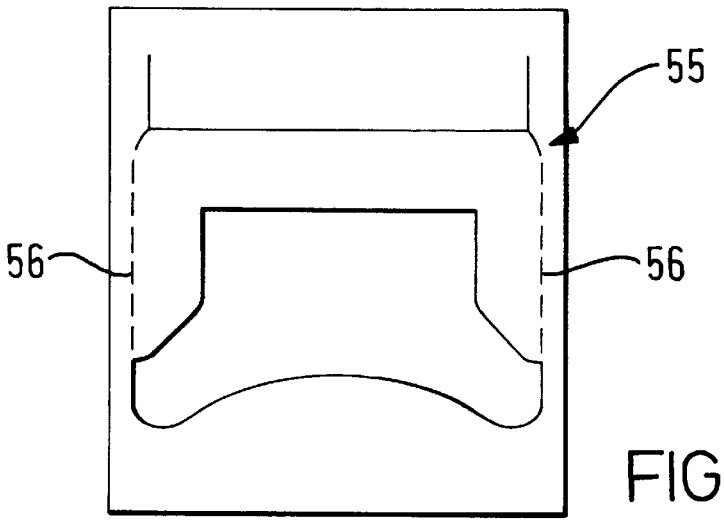
FIG. 15 shows a die cutter profile as used in forming bags in accordance with the invention.

FIG. 15 shows in plan view a further stack of bags, generally similar in principle to the stack illustrated in FIGS. 11 and 12, but having a tongue 51 carrying two points X of adhesive bonding. Reference numerals in FIG. 14 correspond to those used in FIGS. 11 and 12, and the description will not be repeated here. The block header 43 is held together by means of four spot heat-welds 52, formed by passing sharp hot pins through the block header to weld adjacent bridging webs together.

The stack shown in FIG. 14 has somewhat foreshortened lines of connection 44, 45 between the block header 43 and the handle portions 41, 42. Thus, not only is the block header not connected to the handle portions at the ends of the handle portions as measured in a direction away from the bag portion 40, but it is also not connected to the handle portions over substantially the last five percent of the lengths of the handle portions as measured in a direction towards the bag portion 40. In the end region near the bag portion 40, there is instead provided a profile to each handle portion 41, 42, which causes the handle portions to have a relatively narrow neck 53, 54 at their junction with the bag portion 40. This neck suitably has a rounded profile at least in part, which we have found leads to an improved opening effect when the first side of the bag is drawn past the stack restraining means.

The method of manufacturing all the bag stacks illustrated herein is automated and conventional, and will now be briefly described with reference to FIG. 15, which shows a die cutter profile, the blade portions indicated in heavy lining.

Firstly, a cylindrical plastic film is obtained by blown-film extrusion through an annular die in conventional manner. The cylinder is then closed by heat bonding to form a first and second seam at the top and bottom of each bag-forming length of film, and each individual bag-forming length is cut from the film cylinder.

A die cutter 55 as shown in FIG. 15 is then used to cut the top region of the bag-forming length so that the first seam is severed and the through-channel 46, bridging webs and, if desire, tongue 46 are formed. The lines of weakness 44, 45 are formed by lines 56 of interrupted blades to each side of the main blades.

The cut bag is then assembled on a growing stack of previously cut bags by applying the desired region(s) of adhesion to the last bag of the stack before laying the cut bag on and pressing it onto the stack. Once the stack is complete, the block header 43 is formed in conventional manner, examples of which have been indicated above.

We claim:

1. A dispenser, for dispensing individual pre-formed bags from a stack of bags, comprising:

a body part and an anchor part for the stack disposed on the body part;

the anchor part comprising catch means for engaging a stack of pre-formed bags, the stack of pre-formed bags, depending from the catch means, for being grasped for removal; and a stack restraining means comprising elongate member associated with the dispenser and movable between a first position in which the elongate member rests alongside or bears against the stack of pre-formed bags to restrain the stack of pre-formed bags, and a second position in which the elongate member is deflected from its first position against the action of a restoring force to permit one side of a first bag of the stack of pre-formed bags to be drawn past the stack restraining means to open the first bag for loading prior to removal of the first bag from the dispenser.

2. A dispenser according to claim 1, which further comprises stack support means for underlying and supporting a portion of the engaged stack.

3. A dispenser according to claim 1 or 2, in which the stack restraining means bears against the engaged stack.

4. A dispenser, for dispensing individual pre-formed bags from a stack of pre-formed bags, comprising:

a body part and an anchor part for the stack disposed on the body part;

the anchor part comprising a catch means for engaging the stack of pre-formed bags and a stack support means for underlying and supporting a portion of the engaged stack;

the anchor part having the stack of pre-formed bags that is engaged with the catch means, passing over the support means, for being grasped for removal; and a stack restraining means which bears against the engaged stack to restrain the stack to the support means while permitting one side of a first bag of the stack to be drawn past the stack restraining means to open the first bag for loading, prior to removal of the first bag from the dispenser.

5. A dispenser according to claim 1 or 4, in which the catch means comprises a relatively large central hook or plate.

6. A dispenser according to claim 1 or 4, in which the body part comprises a base part from which the anchor part upwardly extends, the catch means being provided relatively far from the base part and the arrangement being such that in use the stack of bags depends from the catch means.

7. A dispenser according to claim 2 or 4, in which the stack support means is adapted to support the engaged stack of bags across substantially the whole width of the stack.

8. A dispenser according to claim 2 or 4, in which the stack support means is adapted to support the stack at an angle to the vertical.

9. A dispenser according to claim 2 or 4, in which the stack support means has one or more side portions which turn up at an angle to the perpendicular from the plane of the stack support means.

10. A dispenser according to claim 1 or 4, wherein the stack restraining means comprises a restraining member which is hinged to the dispenser in such a way that its own weight causes it in use to rest alongside or bear against the stack of bags in the region of the bag mouths under the influence of a gravitational restoring force.

11. A dispenser according to claim 10, in which the restraining member is hinged to the anchor part of the dispenser.

12. A dispenser according to claim 11, in which the restraining member is hinged to the catch means.

13. A dispenser according to claim 10, in which the restraining member is articulated.

14. A dispenser according to claim 13, in which the restraining member comprises first and second restraining member portions hinged mutually together.

15. A dispenser according to claim 14, in which the first and second restraining member portions are of different size and weight compared with each other.

16. A dispenser according to claim 15, in which the first restraining member portion, hinged to the dispenser, is the larger portion.

17. A dispenser according to claim 16, in which the second restraining member portion, articulated to the first portion, serves as a tongue to bear squarely against the engaged stack.

18. A dispenser to claim 10, in which the restraining member of the stack restraining means is hinged to the dispenser via a longitudinally variable hinge.

19. A dispenser according to claim 18, in which the longitudinally variable hinge comprises a slot and pin hinge arrangement in which the hinge pin is retained in an elongate slot along which it can slide to and fro.

* * * * *

UNITED STATES PATENT AND TRADEMARK OFFICE

CERTIFICATE OF CORRECTION

PATENT NO : 5,860,529

DATED : January 19, 1999

INVENTOR(S) : Martin Dominic Smithson and Robert Franklin

It is certified that error appears in the above-identified patent and that said Letters Patent is hereby corrected as shown below:

In Claim 1, column 14, line 59, after "of", insert --pre-form--.

In Claim 1, column 14, line 66, after "comprising", insert --an--.

Signed and Sealed this

Tenth Day of August, 1999

*Attest:*

*Attesting Officer*

Q. TODD DICKINSON

*Acting Commissioner of Patents and Trademarks*